United States Patent [19]

Funk et al.

[11] 4,059,933

[45] Nov. 29, 1977

[54] STRIP FOR FASTENING AND SEALING SHEETS OF CONSTRUCTION MATERIAL

[75] Inventors: Richard S. Funk, Altadena; S. Alan Stewart, Rancho Palos Verdes; David L. Ruff, Torrance, all of Calif.

[73] Assignee: Grefco, Inc., Bala Cynwyd, Pa.

[21] Appl. No.: 776,757

[22] Filed: Mar. 11, 1977

[51] Int. Cl.[2] ..... E04F 19/02

[52] U.S. Cl. ..... 52/127; 52/309.2; 52/309.7; 52/464; 52/467; 428/99; 428/138

[58] Field of Search ..... 52/288, 127, 395, 464, 52/467, 716, 717, 309.2, 309.7, 309.1; 428/55, 99, 131, 138, 159

[56] References Cited

U.S. PATENT DOCUMENTS

| | | | |
|---|---|---|---|
| 1,681,758 | 8/1928 | Wight | 52/459 |
| 1,989,276 | 1/1935 | Howard | 428/99 X |
| 2,122,869 | 7/1938 | Morris | 52/467 X |
| 2,230,688 | 4/1941 | Irwin | 52/396 |
| 2,439,516 | 4/1948 | Holcomb | 174/159 |
| 3,230,817 | 1/1966 | Thomas | 85/28 |
| 3,256,661 | 6/1966 | Fischer | 52/127 X |
| 3,312,026 | 4/1967 | Rolland | 52/403 |
| 3,320,707 | 5/1967 | Berg | 52/464 X |
| 3,339,329 | 9/1967 | Berg | 52/395 |
| 3,353,316 | 11/1967 | Berg | 52/302 |
| 3,381,436 | 5/1968 | Elliott et al. | 52/468 |
| 3,469,490 | 9/1969 | Pearce | 85/1 |
| 3,471,979 | 10/1969 | Herr | 52/716 X |
| 3,570,205 | 3/1971 | Payne | 52/466 |
| 3,750,523 | 8/1973 | Fujita | 85/28 |
| 3,801,417 | 4/1974 | Shanok et al. | 428/138 X |

FOREIGN PATENT DOCUMENTS

| | | | |
|---|---|---|---|
| 769,347 | 10/1967 | Canada | 52/288 |
| 690,554 | 7/1964 | Canada | 52/288 |
| 1,925,577 | 11/1970 | Germany. | |

*Primary Examiner*—Alfred C. Perham
*Attorney, Agent, or Firm*—Everett H. Murray, Jr.; Brian G. Brunsvold; Bruce C. Zotter

[57] ABSTRACT

Apparatus for sealingly joining sheets of construction material laid with edges abutting over an underlying frame and having edges rabbeted to form a joint channel including a pad for lying in the channel, a cap permanently adhered to the pad member and having edges extending past the pad for sealingly contacting the unrabbeted sheet surfaces, a metal strip embedded in the pad, and screws for securing the metal strip to the frame to capture the rabbeted surfaces of the sheets.

24 Claims, 6 Drawing Figures

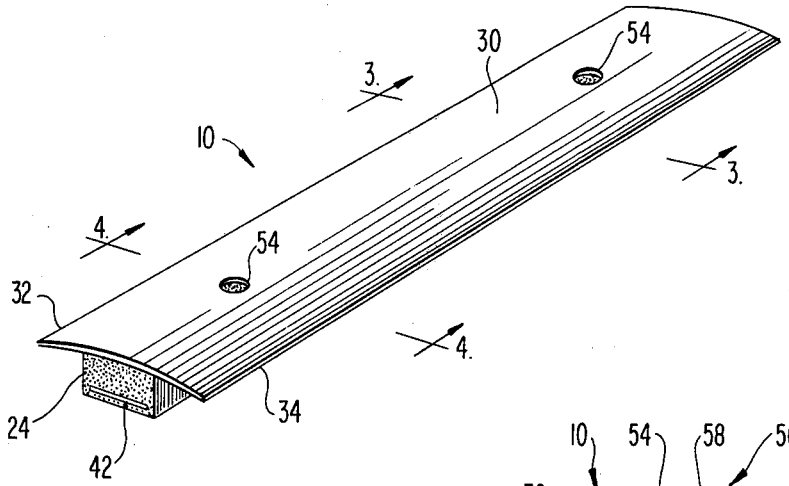
FIG 1
FIG 2
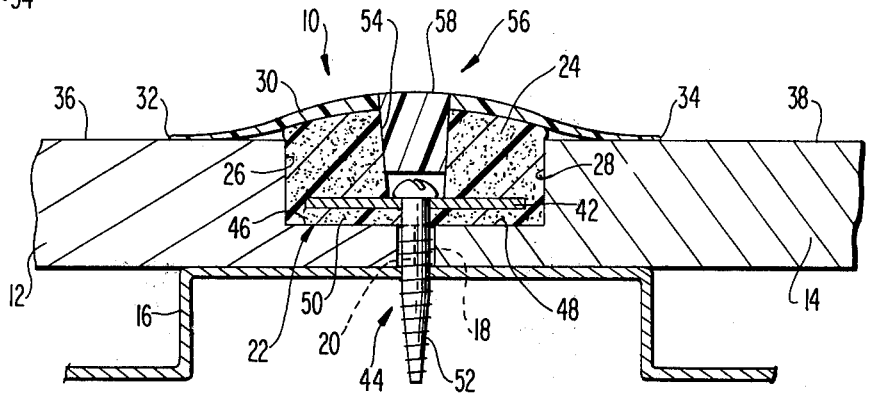
FIG 3
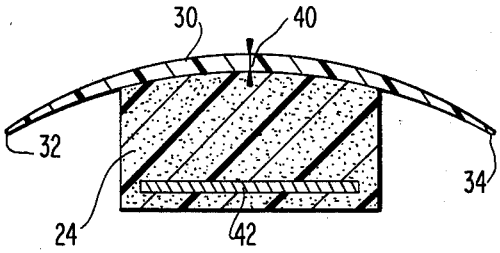
FIG 4
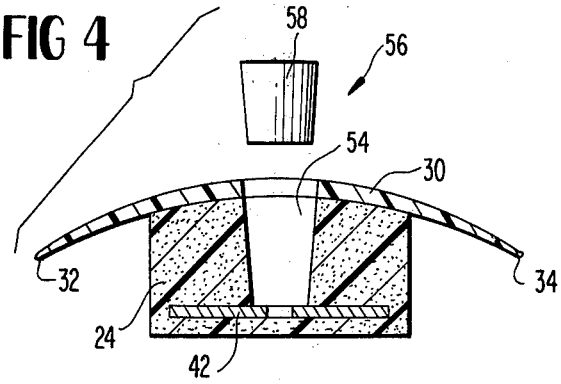
FIG 5
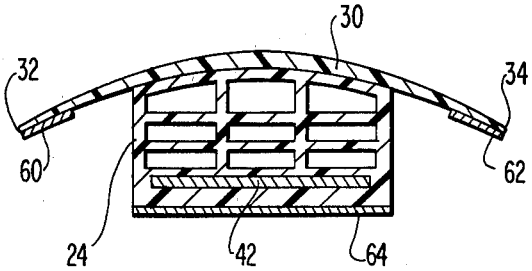
FIG 6
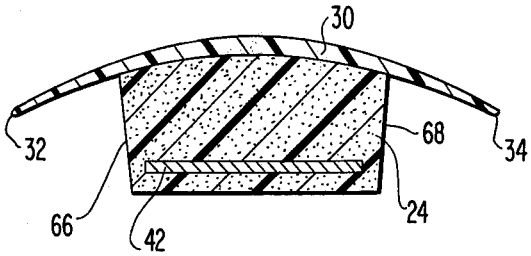

STRIP FOR FASTENING AND SEALING SHEETS OF CONSTRUCTION MATERIAL

BACKGROUND OF THE INVENTION

1. Field of the Invention

This invention is directed to apparatus for fastening and sealing sheets of construction material placed in edgeabutting relation.

The widespread and growing use of construction material in sheet form in all phases of the construction industry has necessitated the development of improved apparatus for fastening together the sheets. Typically, the sheets are positioned over an underlying frame structure with the edges of adjoining sheets abutting to form a joint. In many applications the spacing of the underlying frame members is determined by the dimensions of the sheets so that the joints can be positioned directly over a frame member and so that the sheets can be fastened to the frame structure at the joint locations.

The use of construction materials in sheet form has not been confined to interior applications, and with the development of suitable lightweight weather-proof coatings, the use of sheet material in the fabrication of exterior walls and roofdecks has become commonplace. An example of such sheet material appears in U.S. patent application Ser. No. 702,966. Such exterior applications, however, have required that the fastening apparatus perform a sealing function as well as withstand the additional loadings caused by wind forces and forces induced by thermal expansion and contraction.

2. Description of the Prior Art

U.S. Pat. Nos. 3,320,707 and 3,339,329 to Berg typify apparatus currently used in the construction industry for fastening and sealing sheet material placed in edgeabutting relationship. The apparatus of Berg U.S. Pat. No. 3,320,707 includes a deformable sealing pad, an overlying metal strip, and screws passing through the strip and pad into the underlying frame for forcing the pad into the joint formed by the lipped abutted sheets thereby capturing the sheets. A major problem with such a sheet material fastening device is that, although the metal strip gives the superior hold-down performance needed for exterior applications, the exposed metal acts as an efficient, but unwanted, conductor of heat energy through the joint and past the wall or roof structure. During hot weather this conduction path can result in a significantly increased air conditioning load, while heat losses during the winter months will be reflected in greater heating costs. Such a fastening device, then, is counter-productive, inasmuch as the corresponding sheet materials, especially those intended for roofdeck applications, are usually fabricated for maximum insulating properties.

Also, the direct exposure of metal parts to weathering can lead to corrosion which would necessitate maintenance at unacceptably short intervals during the life of the structure. Such corrosion can be particularly troublesome if dissimilar metals are used for the metal strip and the screws where the galvanic action can greatly accelerate the corrosion rate possibly causing a premature loss of hold-down capability.

Thus a fastener utilizing an unexposed metal strip overlying the edges of the abutted sheets for superior holddown performance but without the attendent heat conduction and corrosion problems of conventional devices would be highly desirable.

With respect to the required sealing function, fasteners such as shown in Berg U.S. Pat. No. 3,320,707 depend upon deformation of the underlying pad against the sheet edges to effect the primary moisture seal in exterior applications. Such as dependency is not altogether satisfactory as deterioration of the pad material and lateral movements in the sheet material caused by thermal expansion and contraction can substantially diminish the sealing effectiveness of such conventional fasteners. Modifications of current fastener configuration such as shown in FIG. 4 of Berg U.S. Pat. No. 3,320,707 and FIG. 3 of Berg U.S. Pat. No. 3,339,329 have attempted to maintain positive contact between the pad member and the exterior facing surfaces of the sheets in an effort to improve the fastener's sealing performance. The aforementioned modifications generally consist of extending the overlying metal or plastic hold-down strip beyond the channel formed by the abutted sheets and by providing that a part of the pad member underlie these extensions to act as a gasket.

These aforementioned modifications are far from being totally satisfactory for several reasons. First, the extending portions of the hold-down strip must be made relatively stiff to compress the underlying pad. The force required to compress these outlying pad portions is unavailable to compress the pad directly over the joint resulting in a decrease in the localized clamping pressure. Decreases in the localized clamping pressure can result in unacceptable lateral movement of the sheets during wind-induced flexing.

Second, the required stiffness of the hold-down strip extensions prevents these appendages from adequately conforming to sheet thickness variations (waviness) along the joint. Portions of the pads underlying the "low spots" may remain uncompressed and provide leakage paths past the intended secondary moisture barrier.

Therefore, a fastener-sealer for edge-abutted sheets of construction material that could accommodate variations in panel thickness without significantly decreasing the localized clamping pressure as is accomplished by the invention, to be described hereafter, would be highly desirable and would certainly find immediate acceptance in the construction industry.

Additional advantages of the invention will be set forth in part in the description which follows, and in part will be obvious from the description, or may be learned by practices of the invention. The advantages of the invention may be realized and attained by means and instrumentalities and combinations particularly pointed out in the appended claims.

SUMMARY OF THE INVENTION

Apparatus is provided for sealingly joining two edge-abutted sheets of a construction material and for attaching the sheets to an underlying frame member positioned beneath the joint, the abutting edges being rabbeted to form a joint channel.

In accordance with the invention, the apparatus comprises a compressible resilient pad member for being drawn into the channel, the pad member extending in the longitudinal direction along the channel and having a transverse dimension for providing an interference fit with the sides of the channel; a resilient cap member permanently adhered to the pad member, the cap member also extending longitudinally along the channel and having transverse edges extending past the pad member for contacting the outwardly-facing surfaces of the sheets when the pad member is drawn into the channel, the extended edges being sufficiently flexible in both the transverse and the longitudinal directions to sealingly conform to the outwardly-facing surfaces; a metal strip embedded in the pad member and extending longitudinally along the channel, the strip being oriented to overlie the junction when the pad member is drawn into the channel; and means for securing the metal strip to the underlying frame member, the pad member being drawn into the channel upon activation of the securing means, and the rabbeted surfaces of the sheets being captured between the portion of the pad underlying the metal strip and the frame member. As herein embodied, the pad member is fabricated from a semi-rigid insulating foam material; the cap member has an arcuate undeformed transverse shape for providing initial contact between the extended edges and the sheet surfaces when the pad member is only partially drawn into the channel; and the securing means include screw means positioned at discrete intervals in the longitudinal direction along the strip. Preferably, the pad member is fabricated from foamed polyvinylchloride (PVC); the cap member is fabricated from solid PVC; holes are provided in the pad member exposing the metal strip at the discrete intervals; and means are provided to seal the holes after the activation of the securing means.

The accompanying drawing, which is incorporated in, and constitutes a part of, this specification, illustrates one embodiment of the invention and, together with the description, serve to explain the principles of the invention.

DESCRIPTION OF THE DRAWING

FIG. 1 is a perspective view of one embodiment of the present invention.

FIG. 2 is a cross-sectional view of the embodiment of FIG. 1 installed.

FIG. 3 is a cross-sectional view of the embodiment of FIG. 1 taken at 3—3.

FIG. 4 is a cross-sectional view of the embodiment of FIG. 1 taken at 4—4.

FIG. 5 is a cross-sectional view of a variation of the embodiment of FIG. 1.

FIG. 6 is a cross-sectional view of yet another variation of the embodiment of the present invention shown in FIG. 1.

DESCRIPTION OF THE PREFERRED EMBODIMENT

Referring now to FIG. 1, apparatus 10 is provided for sealingly joining two edge-abutted sheets of a construction material. As best seen in FIG. 2, the present invention is intended for use with sheets 12 and 14 of a suitable construction material, such as a perlite-foam composite, which are placed in edge-abutting relationship. Sheets 12 and 14 are supported at the joint by rafter member 16, which can be of steel, wood or any other suitable construction material. The abutting edges 18 and 20 of sheets 13 and 14 respectively are rabbeted or mitered to provide a joint channel 22. The particular materials mentioned for use as sheets 12 and 14 and rafter member 16 are for illustration only and are not intended in any way to limit the scope of the invention to be described hereafter in greater detail.

In accordance with the invention, and as broadly described herein, apparatus 10 includes a pad member 24 which extends longitudinally along channel 22 when installed. As best seen in FIG. 2, the transverse dimension of pad 24 is sized to provide an interference fit with the walls 26 and 28 of channel 22, thereby providing a moisture barrier for exterior uses of the apparatus 10.

Pad 24 should be compressible but resilient, and, as embodied herein, a semi-rigid foamed insulating material such as foamed polyvinylchloride is a suitable material for pad member 24. The insulating properties of foamed polyvinylchloride are highly desirable for use with sheet materials having similar insulating properties, especially when intended for roofdeck applications.

As an alternate semi-rigid insulating material, honeycombed polyvinylchloride can be used for the pad member, as is shown in FIG. 5. Elongated honeycombed structures can be easily produced from materials such as PVC by techniques well known in the plastics extrusion art.

As herein embodied, and as can best be seen in FIG. 6, the sides 66 and 68 of pad member 24 can be tapered to insure an interference fit with walls 26 and 28 as well as to facilitate alignment of the pad member 24 in channel 22 during installation.

In accordance with the invention, apparatus 10 also includes a cap member 30 which is fixedly adhered to pad member 24. Cap 30 also extends longitudinally along channel 22 and has transversly extending edges 32 and 34 for contacting the outwardly-facing surfaces 36 and 38 of sheets 12 and 14, respectively, when joining and sealing apparatus 10 is installed. Extending edges 32 and 34 are so fabricated as to be sufficiently flexible in both the longitudinal and transverse direction to sealingly conform to sheet surfaces 36 and 38 for reasonable variations in sheet thickness and for usual surface waviness. This biaxial conformability characteristic is accomplished by making edges 32 and 34 thin and using a resilient material for cap 30. The thin edges 32 and 34 will insure conforming contact without placing an appreciable bending load on cap 30, which load would otherwise decrease the clamping pressure. The resilience of the edges also will allow minor vertical movements in the various components without breaking the sealing contact and, together with the resilience of pad member 24, will allow apparatus 10 to be reuseable after repair or replacement of a defective sheet in an assembled wall or roofdeck.

As herein embodied, solid PVC is used for cap 30 especially when foamed PVC is chosen as the material for pad 24 to facilitate adherence between pad 24 and cap 30 when apparatus 10 is fabricated. It is intended that cap 30 can be permanently adhered to pad 24 using any standard fabrication technique, such as by adhesives, and the manner of joining these components is not intended to limit or otherwise restrict the scope of the present invention.

It is preferred that the centerline thickness 40 of cap 30 (see FIG. 3) is greater than the thickness of edges 32 and 34, to provide increased structural rigidity in the region where cap 30 is affixed to pad 24. And it is also preferred that cap 30 have an arcuate shape to provide initial contact between edges 32 and 34 and surfaces 36 and 38 before the pad member 24 is completely seated in channel 22. This ensures contact along the entire length of edges 32 and 34 when the apparatus 10 is completely installed, particularly when sheets 12 and 14 have nonuniform thicknesses.

As cap member 30 is fixedly adhered to pad member 24, these components constitute a single unit which dispenses with the need for handling and assembling several elongated parts during installation. The resulting one-piece construction may yield significant savings in both fabrication and installation costs over the fasteners currently in use in the construction industry. Savings in fabrication costs would be particularly significant if pad member 24 were formed by foaming a suitable material directly onto cap 30 while the latter was being extruded. But a cap formed separately and fixedly adhered to the pad by a laminating process is acceptable nonetheless and is considered well within the scope of the present invention.

In accordance with the invention, joining and sealing apparatus 10 also includes a metal strip 42 embedded in pad member 24. Metal strip 42 also extends longitudinally along channel 22 and is oriented in pad 24 to overlie the junction of sheets 12 and 14 when apparatus 10 is installed, as can be seen in FIG. 2. Strip 42 can be fabricated of galvanized steel or any other suitable metal. Strip 42 can be implanted during the fabrication of pad 24 by any suitable technique such as by making pad 24 in two pieces and laminating the pieces together with strip 42 sandwiched in-between. If, as it is preferred, pad 24 is of a foamed material, strip 42 can be encapsulated during the foaming procedures by techniques well known in the art.

In accordance with the invention, and as best seen in FIG. 2, the apparatus 10 of the present invention also includes means 44 for securing metal strip 42 to rafter 16. It is intended that the pad member 24 be drawn into channel 22 by the activation of securing means 44 and that the rabbeted surfaces 46 and 48 of sheets 12 and 14, respectively, are captured between the portion 50 of pad 24 underlying strip 42 and the rafter member 16.

As herein embodied, securing means 44 includes screws 52 positioned at discrete intervals along strip 42. Screws 52 should be of a length to engage rafter 16 with pad member 24 completely outside channel 22 in order to facilitate drawing pad member 24 into the channel and causing edges 32 and 34 to contact surfaces 36 and 38, respectively.

It is preferred that holes 54 be provided in the pad member 24 and the overlying cap member 30 at the aforementioned discrete intervals along strip 42. The holes 54 should expose metal strip 42 for insertion and activation of screws 52. And it is also preferred that apparatus 10 further include means 56 to seal holes 54 after the activation of securing means 44. Acceptable sealing means 56 would include plug members 58 fabricated from a suitable material such as PVC and sized for an interference fit in holes 54. Alternatively, a standard caulking compound can be used for sealing means 56. Such compounds are well known in the construction art.

By plugging or caulking individual screw holes 54 from the top, their location can be easily ascertained at such time in the future when the roof must be repaired by removing and replacing damaged panels. The plugs or caulking can be removed and screws 52 backed out using conventional tools such as a reversible screw gun.

As embodied herein, and as best seen in FIG. 5, sealing and joining apparatus 10 further includes material formed on the undersides 60 and 62 of edges 32 and 34, respectively, for promoting sealing upon contact with sheet surfaces 36 and 38. Preferably, butyl mastic tape is used for the material at 60 and 62. This tape can be protected until installation by a peelable protective release paper covering, a technique well known in the art. It is also preferred that sealing material be formed on the underside of pad 24 to insure sealing contact with rabbeted surfaces 46 and 48 and that butyl mastic tape also be used for the sealing material at 64.

The invention in its broader aspects is not limited to the specific details shown and described and departures may be made from such details without departing from the principles of the invention and without sacrificing its chief advantages. Also, it will be apparent to those skilled in the art that various modifications and variations could be made in the apparatus of the invention without departing from the scope or spirit of the invention.

What is claimed is:

1. An apparatus for sealingly joining two edge-abutted sheets of construction meterial and for attaching the sheets to an underlying frame, the sheets having outwardly-facing surfaces and being oriented with the abutted edges positioned over a frame member, the abutted edges being rabbeted to form a channel along the junction of the sheets, the apparatus comprising:

a. a compressible resilient pad member for being drawn into the channel, said pad member extending in the longitudinal direction along the channel and having a transverse dimension for providing an interference fit with the sides of the channel when said pad member is drawn into the channel;

b. a resilient cap member permanently adhered to said pad member, said cap member extending longitudinally along the channel and having edges extending in the transverse direction past said pad member for contacting the outwardly-facing surfaces of the abutted sheets when said pad member is drawn into the channel, said extended edges being sufficiently flexible in both the transverse and longitudinal directions to sealingly conform to the outwardly-facing surfaces when said extended edges have been made to contact the outwardly-facing surfaces;

c. a metal strip embedded in said pad member and extending longitudinally along the channel, said strip being oriented to overlie the junction when said pad member is drawn into the channel; and d. means for securing said metal strip to the frame member, said pad member being drawn into the channel upon activation of said securing means, the rabbeted surfaces of the sheets being captured between the portion of said pad underlying said metal strip and the frame member.

2. The apparatus of claim 1 in which said pad member is constructed of a semi-rigid insulating foam material.

3. The apparatus of claim 2 wherein said foam material is foamed polyvinylchloride.

4. The apparatus of claim 1 in which said pad member is constructed of a semi-rigid insulating honeycombed material.

5. The apparatus of claim 4 wherein said honeycombed material is polyvinylchloride.

6. The apparatus of claim 1 wherein said pad member has tapered sides to tighten said interference fit when said pad member is drawn into the channel.

7. The apparatus of claim 1 wherein said cap member has an arcuate undeformed transverse shape for providing initial contact between said extended edges and the outwardly-facing surfaces when said pad member is partially drawn into the channel.

8. The apparatus of claim 1 wherein the thickness of said cap member varies in the transverse direction, said thickness being the greatest at the center and the least at the periphery of said extended edges.

9. The apparatus of claim 1 wherein said cap member is fabricated from polyvinylchloride.

10. The apparatus of claim 1 wherein said securing means includes screw means positioned at discrete intervals in the longitudinal direction along said strip.

11. The apparatus of claim 10 wherein holes are provided in said cap member and said pad member, said holes being located at said discrete intervals and exposing said metal strip for engagement by said screw means, and said apparatus further comprising means for sealing said holes after the activation of said securing means.

12. The apparatus of claim 11 wherein said sealing means includes plug members.

13. The apparatus of claim 11 wherein said sealing means includes a caulking compound.

14. The apparatus of claim 1 further comprising sealant material formed on the undersides of said extended edges for adhering to the outwardly-facing surfaces upon contact between said extended edges and the outwardly-facing surfaces when said pad is drawn into the channel.

15. The apparatus of claim 14 wherein said sealant material is butyl mastic sealant tape.

16. The apparatus of claim 1 further comprising sealant material formed on the underside of said pad member for adhering to the rabbeted surfaces of the channel when said pad is drawn into the channel.

17. The apparatus of claim 16 wherein said sealant material is butyl sealant tape.

18. An apparatus for sealingly joining two edge-abutted sheets of a construction material and for attaching the sheets to an underlying frame, the sheets having outwardly-facing surfaces and being oriented with the abutted edges positioned over an underlying frame member, and the abutted edges being rabbeted to form a channel along the junction of the sheets, the apparatus comprising:

a. a compressible resilient pad member of foamed polyvinylchloride for being drawn into the channel, said pad extending in the longitudinal direction along the channel and having a transverse dimension for providing an interference fit with the sides of the channel when said pad is drawn into the channel;

b. a resilient cap member of solid polyvinylchloride permanently adhered to said pad member, said cap member extending longitudinally along the channel, and said cap member having edges extending in the transverse direction past said pad member for contacting the outwardly-facing surfaces of the abutted sheets when said pad member is drawn into the channel, said cap member having an arcuate undeformed transverse shape for providing initial contact between said extended edges and the outwardly-facing surfaces when said pad member is partially drawn into the channel, and said extended edges being sufficiently flexible in both the transverse and longitudinal directions to sealingly conform to the outwardly-facing surfaces when said extended edges have contacted the outwardly-facing surfaces;

c. a metal strip embedded in said pad member, said strip extending longitudinally along the channel, said strip being oriented to overlie the junction when said pad member is drawn into the channel;

d. means for securing said strip to the frame member, said securing means including screw means positioned at discrete intervals in the longitudinal direction along said strip, both said cap member and said pad member being provided with holes exposing said metal strip at said discrete intervals, and said pad member being drawn into the channel upon the activation of said securing means, the rabbeted surfaces of the sheets being captured between the portion of said pad underlying said metal strip and the frame member; and e. means for sealing said holes after the activation of said securing means.

19. The apparatus of claim 18 further comprising sealant material formed on the undersides of said extended edges and on the underside of said pad member for adhering said extended edges to the outwardly-facing surfaces and said pad member to the rabbeted surfaces, respectively.

20. The apparatus of claim 19 wherein said sealant material is butyl mastic sealant tape.

21. A structure for use in the building industry, the structure being attached to an underlying frame, the structure comprising:

a. at least two sheets of a construction material laid edge-to-edge on the frame, said abutted edges being positioned over an underlying member of the frame, said sheets having outwardly-facing surfaces and said abutted edges being rabbeted to form a channel along the junction of said sheets;

b. a compressible resilient pad member positioned in said channel, said pad member extending longitudinally along the channel, and said pad member having a transverse dimension providing an interference fit with the walls of said channel;

c. a longitudinally extending resilient cap member permanently adhered to said pad member, said cap member having longitudinally and transversely flexible edges extending in the transverse direction past the pad member, said edges being deformed to sealingly conform to said outwardly-facing surfaces;

d. a longitudinally extending metal strip embedded in said pad member, said strip overlying said junction;

e. means securing said metal strip to said frame member, the rabbeted surfaces of said sheets being captured between said strip and said frame member, said pad being held in interference fit with the walls of said channel, and said flexible edges being maintained in deformed, sealingly conforming contact with said outwardly-facing surfaces by said securing means.

22. The structure of claim 21 wherein a. said pad member is foamed polyvinylchloride;

b. said cap member is polyvinylchloride; and c. said securing means includes screw means located at discrete intervals along the longitudinal dimension of said strip.

23. The structure of claim 21 further comprising sealant material formed between said outwardly-facing surfaces and said extended edges and between said pad and said rabbeted surfaces.

24. The structure of claim 23 wherein said sealant material is butyl mastic material in tape form.

* * * * *

UNITED STATES PATENT AND TRADEMARK OFFICE

CERTIFICATE OF CORRECTION

PATENT NO. : 4,059,933

DATED : November 29, 1977

INVENTOR(S) : Richard S. Funk, S. Alan Stewart, David L. Ruff

It is certified that error appears in the above-identified patent and that said Letters Patent are hereby corrected as shown below:

Column 6, line 15, after "of", insert ---a--- and change "meterial" to ---material---.

Column 7, line 33, after "butyl", insert ---mastic---.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*